United States Patent [19]

Schneeweiss

[11] Patent Number: 4,768,421

[45] Date of Patent: Sep. 6, 1988

[54] RADIAL PISTON MACHINE WITH SHAFT RADIAL POSITION STROKE CONTROL

[75] Inventor: Dieter Schneeweiss, Memmingen-Volkrathofen, Fed. Rep. of Germany

[73] Assignee: G. Düsterloh GmbH, Sprockhövel, Fed. Rep. of Germany

[21] Appl. No.: 796,394

[22] Filed: Nov. 7, 1985

[30] Foreign Application Priority Data

Nov. 7, 1984 [DE] Fed. Rep. of Germany ..... 3440543

[51] Int. Cl.[4] ..... F01B 1/06; F03C 1/04; F04B 1/06

[52] U.S. Cl. ..... 91/497; 92/12.2; 417/221; 74/568 R; 74/571 M; 91/492

[58] Field of Search ..... 92/12.1, 12.2; 91/491, 91/497, 492; 74/568 R, 570, 571 M; 417/221

[56] References Cited

U.S. PATENT DOCUMENTS

| | | | |
|---|---|---|---|
| 1,321,086 | 11/1919 | Centrvall | 91/497 X |
| 1,612,883 | 1/1927 | Schneggenburger | 91/497 X |
| 3,339,460 | 9/1967 | Birdwell | 91/491 |
| 3,492,948 | 2/1970 | Platt | 91/497 X |
| 4,548,124 | 10/1985 | Ortelli | 92/12.1 |

FOREIGN PATENT DOCUMENTS

| | | | |
|---|---|---|---|
| 2203054 | 8/1972 | Fed. Rep. of Germany . | |
| 2654526 | 9/1982 | Fed. Rep. of Germany . | |
| 3109706 | 10/1982 | Fed. Rep. of Germany . | |
| 547531 | 9/1956 | Italy | 92/12.1 |
| 2049034A | 12/1980 | United Kingdom | 417/221 |

*Primary Examiner*—Edward K. Look
*Assistant Examiner*—George Kapsalas
*Attorney, Agent, or Firm*—Michael J. Striker

[57] ABSTRACT

A hydraulic radial piston machine with steplessly adjustable volumetric displacement and piston stroke has a bank of pistons with axes in a common plane transverse to the shaft and machine axes. A radially displaceable supporting member pivotably connected to a shaft longitudinal portion turnable from the machine longitudinal axis supports the pistons. The longitudinal portion is pivotably connected at one end to a further longitudinal shaft portion. The second end connects to a turning link transmission which rotates. Rotation of the first—mentioned longitudinal shaft portion causes the supporting member to travel a circular path around the machine axis. A force—loaded translating operating displacing member steplessly varies the diameter of this circle to steplessly adjust piston stroke.

10 Claims, 2 Drawing Sheets

RADIAL PISTON MACHINE WITH SHAFT RADIAL POSITION STROKE CONTROL

BACKGROUND OF THE INVENTION

1. Field of the Invention

The present invention relates to a fluid radial piston machine, particularly a hydraulic radial piston machine with a steplessly adjustable volume and with a plurality of pistons which extend in a plane transverse to the longitudinal plane of the machine and are slidingly supported by a supporting member displaceable radially to a radial machine shaft.

2. Brief Description of the Prior Art

Fluid radial piston machines of the above mentioned general type are known in the art. One such machine is disclosed, for example, in the DE-OS No. 2,203,054. This machine has eccentric displacement with hydraulically actuated displacing pistons provided inside an eccentric ring. Such a construction is generally recommended when the eccentric ring because of structural volumes of the machine can be dimensioned sufficiently large for providing the displacing pistons with satisfactory displacing force. In this case they can run in operationally secure manner only in the end positions of the eccentricity, since the displacing pistons are not fixed in intermediate positions. This machine is also formed as a machine which is switchable in two steps.

The DE-PS No. 2,654,526 discloses eccentric displacements with steplessly operating displacing pistons inside an eccentric ring. However, for using double-acting unlockable return valves which are arranged in bearing pins of the machine in immediate vicinity to the displacing cylinder, additional accommodating space is needed. Here the stepless displaceability with stable intermediate position is limited to the machine size whose volume (absorption volume in radial piston motor, displacement volume in the radial piston pump) is limited to minimum approximately 500 $cm^3$. In the machines of sizes with a volume below substantially 500 $cm^3$ the operation has been limited to stepped displacement and piston switching has been used as an operational principle, as disclosed for example in DE-OS No. 3,109,706. When individual pistons are cut off from the pressure supply by means of three switched valve, a machine switchable in two or more conditions is obtained. The structural principle cannot be used however for motors in which the pistons are held in a form-locking manner on a machine shaft (crank shaft). Also these motors cannot be switched normally during the operation.

SUMMARY OF THE INVENTION

Accordingly, it is an object of the present invention to provide a fluid radial piston machine of the above mentioned general type, which avoids the disadvantages of the prior art.

More particularly, it is an object of the present invention to provide a fluid radial piston machine which with relatively small structural sizes with an absorption or displacement volume substantially below 500 $cm^3$ can guarantee a stepless change of the absorption or displacement volume.

In keeping with these objects and with others which will become apparent hereinafter, one feature of the present invention resides, briefly stated, in fluid radial piston machine which has the machine shaft having a longitudinal portion which extends through the transverse plane and is turnable from the longitudinal axis of the machine, the longitudinal portion being spatially pivotably connected with the supporting member, the machine shaft having a further longitudinal portion which is rotatable about the longitudinal axis of the machine and axially non-displaceable, the first-mentioned longitudinal portion of the machine shaft having a first end which coincides with the longitudinal axis of the machine and is spatially pivotably connected with the further longitudinal portion of the machine shaft, the first-mentioned longitudinal portion of the machine shaft having another end which is radially displaceable from the longitudinal axis of the machine, a force-loaded translating operating displacing member, and a turning link transmission having turning axes extending normal to the longitudinal axis of the machine, the other end of the further longitudinal portion of the machine shaft being connected with the turning link transmission so as to rotate together with the latter and with incorporation of the displacing member.

For stepless radial displacement of the supporting member which is loaded by the working piston, a longitudinal portion of the machine shaft is turnable. The turning comes from a force-loading translating operating displacing member whose translatory force direction is converted via the turning link transmission arranged near the transverse plane of the working pistons into a radial force direction. The displacing mechanism lies near the row of pistons. As a result of this the supporting member can have very small dimensions. It is however required that it can be coupled spatially with the longitudinal portion of the machine which is turnable from the longitudinal axis of the machine so as to guarantee the rotation, and insignificant relative movement relative to the working pistons because of the turning shaft portion, and the turning movement of the shaft portion relative to the supporting member. Thereby the supporting member shrinks to a size which allows stepless adjustment of radial machines with an absorption or displacement volume below approximately 500$cm^3$.

In accordance with another feature of the present invention the displacing member is formed as a single-acting hydraulic cylinder-piston unit whose longitudinal axis coincides with the longitudinal axis of the machine and whose axially movable part is supported on a sliding piece which is displaceable against the elastic return force of the spring, wherein the sliding piece is pivotably connected with the turning link transmission. When the machine is designed in accordance with this feature no fixed connection is provided between the turning link transmission and the single-acting hydraulic cylinder-piston unit. The hydraulic cylinder-piston unit does not have to be formed rotatable. The return spring serves in the turning link transmission so that in pressureless condition the turnable shaft portion is displaced in the direction of the longitudinal axis of the machine and thereby the absorption or displacement volume is zero. On the other hand, by respective loading of the hydraulic cylinder-piston unit the inclination of the turnable shaft portion relative to the longitudinal axis of the machine and thereby absorption and displacement volume can be changed in a stepless manner.

In accordance with still another feature of the present invention, the displacing member is formed as a double-acting cylinder-piston unit whose longitudinal axis coincides with the longitudinal axis of the machine and whose piston rod is connected via a compensating link with the turning link transmission. In this case a fixed connection of the double-acting hydraulic cylinder-piston unit with the turning link transmission is provided. Such connection requires however a rotary connection between the hydraulic cylinder-piston unit and the turning link transmission. It can be provided, for example, by the pivot axle between the piston rod and the compensating link. Also the piston rod and the piston can be in some cases supported in a rotatable manner. In this embodiment, the piston rod chamber must be loaded with the pressure medium so that the turnable shaft portion in the event pressureless working cylinders is directed along the longitudinal axis of the machine. This can be achieved by a spring which for example is provided in the piston rod chamber.

A further feature of the invention is that the turnable shaft portion is rigid over its entire length and the supporting member which is spatially pivotably connected with the same is displaceable parallel to the longitudinal axis of the machine. The formation of the turnable shaft portion rigid over its entire length is of advantage when the supporting member relative to the working pistons is arranged displaceably parallel to the longitudinal axis of the machine. In this manner it is taken into consideration that the spatial pivot between the turnable shaft portion and the supporting member performs an arcuate path during inclination changes of the shaft portion relative to the longitudinal axis of the machine, which no longer extends in the common transverse plane of the central axes of the working pistons.

The displacing members described hereinabove and formed as hydraulic cylinder-piston units are always located longitudinal axes coincident with the longitudinal axes of the machine and arranged in extension of the turnable shaft portion when it is located on the longitudinal axis of the machine.

In accordance with a still further embodiment of the invention, the turnable shaft portion is formed as hydraulically actuated telescoping cylinder-piston unit whose housing carries the supporting member on which the working pistons are supported spatially pivotably. In accordance with this embodiment the turnable shaft portion itself is formed as displacing member. The telescoping cylinder-piston unit can be single-acting or double-acting. Since the cylinder housing also performs a turning movement about the pivot point on the axially non-displaceably supported longitudinal portion of the machine shaft, it is required that the support member connected with the cylinder housing be formed so that the working pistons are spatially pivotally supported on the supporting member. For this purpose, the supporting member can be provided with a partially spherical surface on which the connecting rod shoes articulatedly connected with the working pistons are supported. The supporting member can also be formed as described hereinabove.

Depending on the type of loading, telescoping shaft portion can be advantageously provided, in accordance with the invention with a force-loaded translatorily acting pushing member as described hereinabove in connection with single-acting or double-acting hydraulic cylinder-piston units.

Another feature of the invention is that the turning link transmission has an axially non-displaceable support which is rotatable parallel to the transverse plane about the longitudinal axis of the machine and through which the turnable shaft portion extends so as to be taken along in rotation but to be radially relatively displaceable. A turning link is pivotably connected with the support at a radial distance from the longitudinal axis of the machine and is pivotably connected with a further turning link pivotably connected with the end of the shaft portion, and also with the sliding piece or the compensating link. In accordance with this embodiment, the rigid or telescopable turnable shaft portion extends through the support which is for example disc-shaped or plate-shaped so that the support can be taken along in rotation, but it is guaranteed that the shaft portion can perform in the support the desired radial relative displacement. With forced action upon the pivot between both mutually connected turning links, the angle between the turning links changes and in this manner the angle of inclination of the turnable shaft portion relative to the longitudinal axis of the machine also changes. Correspondingly, the supporting member displaces and thereby the absorption or displacement volume changes.

A further feature of the present invention is that the turning link transmission has a support which rotates parallel to the transverse plane about the longitudinal axis of the machine and through which the turnable shaft portion extends so that it is taken along but is radially relatively displaceable. A turning link is mounted on the support in a radial distance from the longitudinal axis of the machine and is pivotably connected with the other end of at least the turnable shaft portion. In this embodiment the turning link transmission can have only one turning link which is pivotably connected on the one hand to the support and on the other hand to the end of the shaft portion turnable from the longitudinal axis of the machine. This embodiment is especially advantageous when the turnable shaft portion is formed as hydraulic cylinder-piston unit, and a further hydraulic cylinder-piston unit acts as the pushing member on the turning link transmission directly or indirectly. It is further of advantage when a further turnable shaft portion of a second piston rod is also connected with the turning link. Here the shaft portion can be rigid or telescopable.

In the central longitudinal region of the turning link, a compensating link can be connected which is pivotably connected at the other side with the piston rod of a cylinder-piston unit loaded from the side of the piston rod. In this embodiment between the turning link transmission and the hydraulic cylinder-piston unit, a compensating link is provided as a displacing member. It compensates for spatial changes of the turning link relative to the longitudinal axis of the machine.

Still a further feature of the present invention is that the rotatable support can be supported axially non-displaceably. When two rows of pistons are coupled with two turnable and telescopable shaft portions with a turning link transmission with only one turning link, the rotatable support is advantageously supported in axially non-displaceable manner. Since a longitudinal compensation is performed inside the telescopable shaft portion, the coupling point to the longitudinal portion of the machine shaft rotatable in the longitudinal axis of the machine must not be changed in its operating position.

Finally, the rotatable support can be supported axially displaceably and subjected to the action of adjusting means. This can be practical in the embodiment with only one row of pistons as well as with two rows of pistons. In this case the support forms itself the displacing member, and the adjusting means for displacement of the displacing member can be hydraulic, pneumatic, electrical or mechanical. However, in the embodiment with two rows of pistons it is necessary to support displacably the connecting point between a turnable rigid shaft portion and the associated longitudinal portion rotatable in the longitudinal axis of the machine, in direction of the longitudinal axis of the machine. This feature can be dispensed with when one of the shaft portions is formed telescopable.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
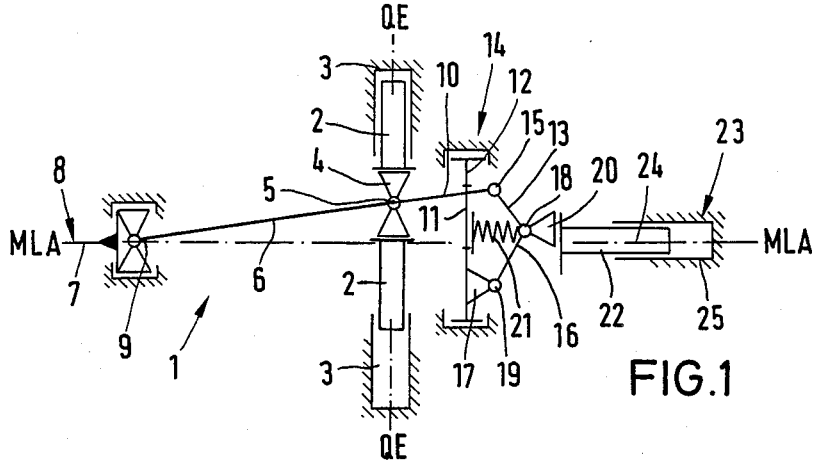
FIGS. 1–6 are views schematically showing radial piston machines in accordance with several embodiments of the present invention.

A fluid radial piston machine shown in FIG. 1 is a radial piston motor which is identified as a whole with reference numeral 1. It has for example five working pistons 2 which are arranged in a transverse plane QE extending transversely to a longitudinal axis of the motor MLA. The working pistons 2 slide radially in working cylinders 3. They are slidingly supported on a supporting member 4 which is displaceable parallel to the longitudinal axis of the machine MLA relative to the working pistons 2.

The supporting member 4 is connected via a spatial pivot 5 with a rigid shaft portion 6 which is turnably radially relative to the longitudinal axis of the machine MLA. The shaft portion 6 has an end 9 which coincides with the longitudinal axis of the machine MLA and is connected by means of a spatial pivot with a longitudinal portion 7 of a machine shaft 8. The longitudinal portion 7 is rotatable about the longitudinal axis of the machine MLA, but is axially non-displaceable relative to the latter.

The turnable shaft portion 6 has an end 10 which displaces radially from the longitudinal axis of the machine MLA and extends through a slot 11 in a disc-shaped support 12. The disc shaped support 12 rotates about the longitudinal axis of the machine MLA, but is axially non-displaceable relative to the latter. The slot or the slot-like opening 11 in the support 12 for the shaft portion 6 is dimensioned so that the support 12 is unobjectionably taken along from the shaft portion 6 in the sense of rotation and the shaft portion 6 can radially displace in the slot 11.

The end 10 which is displaceable from the longitudinal axis of the machine MLA is articulately connected with a turning link 13 of a turning link transmission 14. A turning axle 15 extends at a distance near the longitudinal axis of the machine MLA and normal to the latter. The turning link transmission 14 includes a further turning link 16 which is articulately coupled with a console 17 connected to the support 12, on the one hand, and with the turning link 13, on the other hand. Both a turning axle 18 between both turning links 13 and 16, and a turning axle 19 between the console 17 and the turning link 16 extend near the longitudinal axis of the machine MLA and normal to the latter.

A sliding piece 20 is pivotably connected with the turning axle 18 and is arranged under the action of a spring 21 located between the support 12 and the turning axle 18. The sliding piece 20 is supported against a plunger 22 of a single-acting hydraulic cylinder-piston unit 23 but is not connected with the plunger. A longitudinal axis 24 of the cylinder-piston unit 23 coincides with the longitudinal axis of the machine MLA.

When the radial piston motor 1 is not loaded and the hydraulic cylinder-piston unit is also not loaded, the return spring 21 presses the plunger 22 into a cylinder 25 of the cylinder-piston unit and thereby displaces the shaft portion 6 to the longitudinal axis of the machine MLA. The absorption value is than equal to zero. With respective loading of the hydraulic cylinder-piston unit 23 against the return force of the spring 21, the plunger 22 can be extended, and the turnable shaft portion 6 is radially displaced via the sliding piece 20 and the turning link transmission 14 so that the supporting member 4 is also radially displaced. In this manner the absorption volume of the radial piston motor 1 is steplessly changeable.

Figure 2:
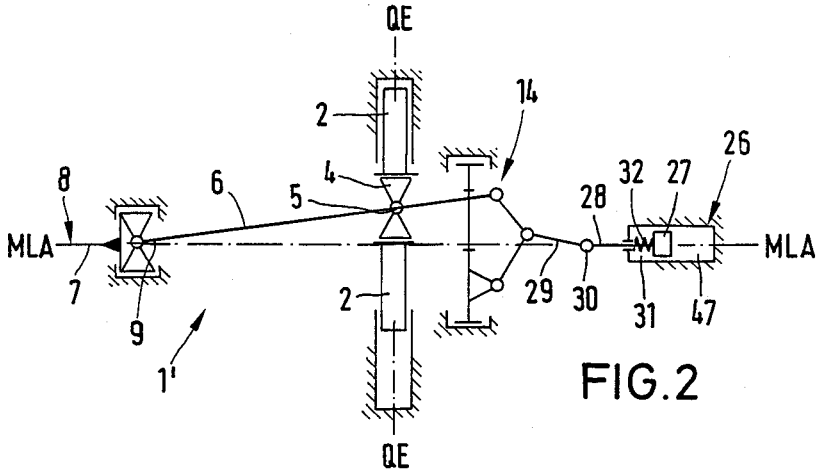

In a radial piston motor 1′ in accordance with the embodiment shown in FIG. 2, the single-acting hydraulic cylinder-piston unit of FIG. 1 is replaced by a double-acting hydraulic cylinder-piston unit 26. The hydraulic cylinder-piston unit 26 has a piston 27 with a piston rod 28 which is pivotably connected via a compensating link 29 with the turning link transmission 14 of FIG. 1. In addition to the turning link transmission 14, also other structural elements of this embodiment correspond to the embodiment of FIG. 1. Additional explanation is superfluous.

Because of the direct connection of the hydraulic cylinder-piston unit 26 with the turning link transmission 14, it is however necessary to support for example the piston rod 28 or the piston 27 of the hydraulic cylinder-piston unit 26 in a rotary manner. Such connection can be provided in a turning axle 30 between the piston rod 28 and the compensating link 29. Moreover, it is advantageous to arrange a pressure spring 32 in a piston rod chamber 31. The pressure spring 32 has the purpose of displacing back the turnable shaft portion 6 to the longitudinal axis of the machine MLA when the radial piston motor 1 is under no pressure. This feature can also be provided by respective pressure loading of the piston rod chamber 31. Moreover, the compensating link 29 can be formed as variab1e imbalance compensating member.

Figure 3:
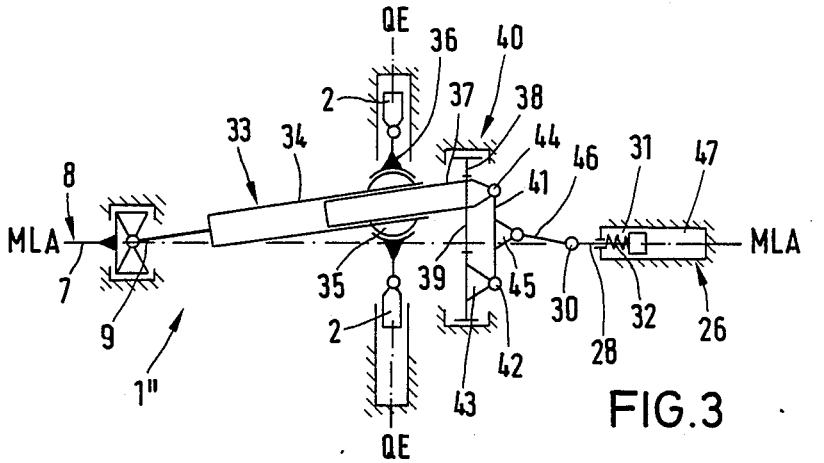

A radial piston motor 1″ shown in FIG. 3 has the turnable shaft portion which is formed as hydraulically operable telescoping cylinder-unit 33. The telescopic cylinder-piston unit 33 can operate as a single-acting or a double-acting cylinder-piston unit. A supporting member 35 with partially spherical surfaces is formed on a cylinder 34. Respectively designed connected rod shoes 36 are supported on the surfaces of the supporting member 35 and articulately connected with the working pistons 2.

The shaft portion 6 has the end 9 which coincides with the longitudinal machine axis MLA and is connected by a spatial pivot with the axially non-displaceable longitudinal portion 7 of the machine shaft 8 which is rotatable in the longitudinal axis of the machine, in correspondence with the embodiment of FIGS. 1 and 2.

A telescopable longitudinal portion 37 of the cylinder-piston unit 33 extends through a disc-shaped support 38 which is rotatable about the longitudinal axis of the machine MLA but is non-displaceable in direction of the longitudinal axis of the machine MLA. For this purpose the support 38 has a slot 39, and the telescopable portion 38 extends through the slot 39 so that the support 38 is taken along in the direction of rotation and the telescopable portion 37 can displace radially.

The support 38 forms a component for turning link transmission 40. The turning link transmission 40 has a turning link 41 which is connected via a turning axle 42 to a console 43 connected with the support 38, on the one hand, and is connected via a turning axle 44 with the telescopable portion 37 of the telescopable cylinder-piston unit 33, on the other hand. Both turning axles 42 and 44 extend near the longitudinal axis of the machine MLA and are normal to the latter.

A console 45 is mounted substantially centrally of the turning link 41 and pivotably connected with a compensating link 46. The other end portion of the compensating link 46 is pivotably connected via a pivot 30 with the piston rod 28 of the hydraulic cylinder-piston unit 26, as described for example in respect to FIG. 2.

Depending on the loading of the turnable telescopable cylinder-piston unit 33, the hydraulic cylinder-piston unit 26 which forms the displacing member is loaded mechanically by the spring 32 in the piston rod chamber 31 or hydraulically in the piston rod chamber 31 or in some cases also in a piston chamber 47.

Figure 4:
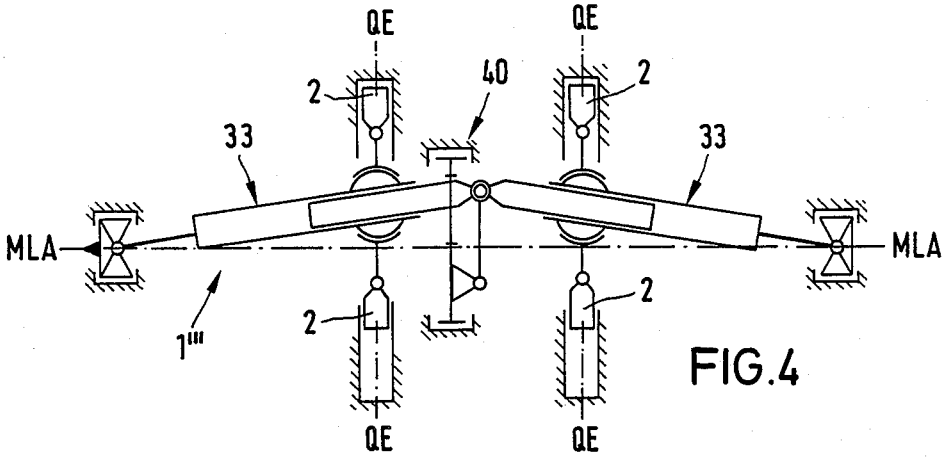

FIG. 4 shows a radial piston motor 1''' with two rows of working pistons 2. An arrangement for the displacement is selected in correspondence with FIG. 3, with the exception of the hydraulic cylinder-piston unit 26. The latter is dispensed with in the embodiment of FIG. 4, since by respective loading of the telescoping cylinder-piston unit 33 its inclination relative to the longitudinal axis of the machine MLA can be changed via the turning link transmission 40 and thereby the absorption volumes can be changed.

Figure 5:
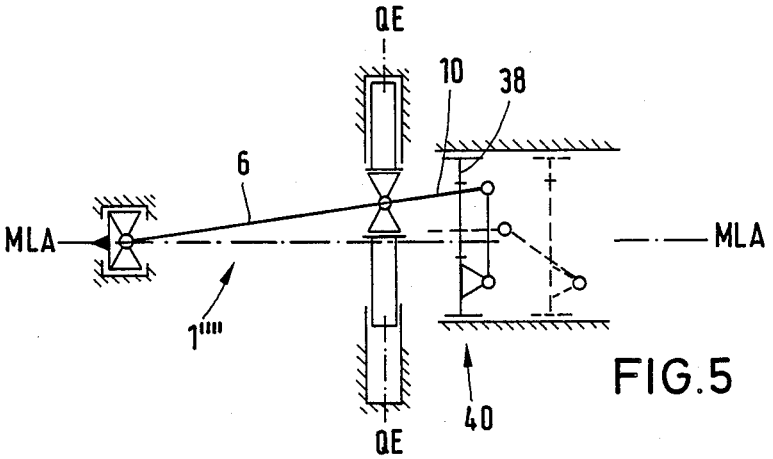

In the embodiment of FIG. 5, a radial piston motor 1'''' has a rigid turnable shaft portion 6 and a row of pistons corresponding to the embodiment of FIGS. 1 and 2. The shaft portion 6 has the end 10 which is turnable from the longitudinal axis of the machine MLA, but coupled with a turning link transmission 40 which is shown in FIG. 3. The difference is that the support 38 is no longer axially displaceable.

The adjusting means required here can be hydraulic, pneumatic, electrical or mechanical. It is to be clear that by displacement of the support 38 parallel to the longitudinal axis of the machine MLA, to the operational position in interrupted linear guidance, the inclination of the turnable shaft portion 6 relative to the longitudinal axis of the machine MLA and thereby absorption volume of the radial piston mctor 1'''' can be changed.

Figure 6:
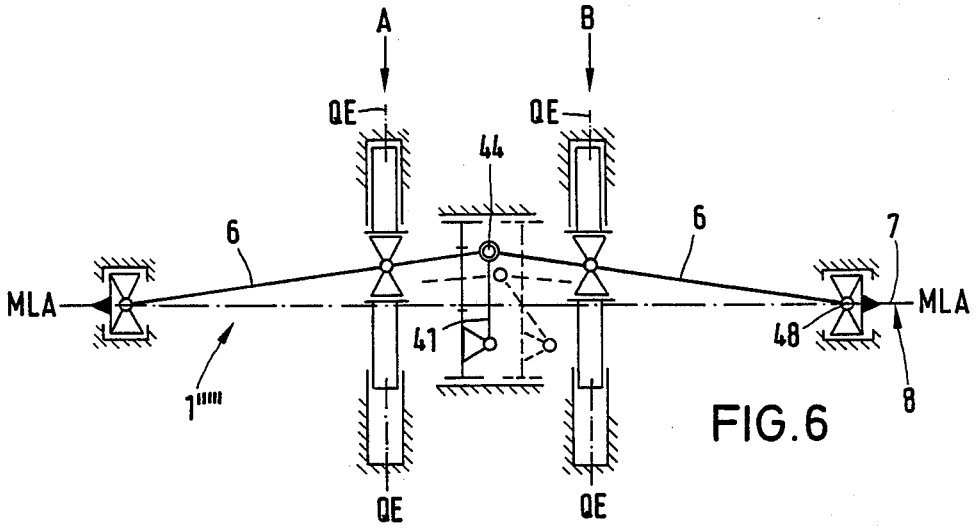

In principle this possibility is also provided in radial piston motor 1''''' with two rows of working pistons A and B in accordance with the embodiment of FIG. 6. Here also the turnable shaft portion 6 of the second piston row B is connected in a pivot point 44 of the turning link 41 with the shaft portion 6 of the first piston row A. However, in this embodiment the connecting point 48 of the turnable shaft portion 6 of the second working piston row B with the associated longitudinal portion 7 of the machine shaft 8 rotatable about the longitudinal axis of the machine MLA must be arranged displaceably in direction of the longitudinal axis of the machine MLA. Such a displaceability can be dispensed with when the turnable shaft portion 6 is formed as a single-acting or a double-acting cylinder-piston unit 33 in correspondence with the embodiments of FIGS. 3 or 4.

It will be understood that each of the elements described above, or two or more together, may also find a useful application in other types of constructions differing from the types described above.

While the invention has been illustrated and described as embodied in a fluid radial piston machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A fluid radial piston machine, particularly a hydraulic radial piston machine, comprising a plurality of working pistons having central axes arranged in a common transverse plane extending transversely to the longitudinal axis of the machine; a supporting member on which said working pistons slidingly lie at least directly; a force-loaded translating operating displacing member; a machine shaft connected with said supporting member, said supporting member being displaceable radially relative to said machine shaft, said machine shaft having a longitudinal portion which extends through said transverse plane and is turnable from said longitudinal axis of the machine under the action of said displacing member, said longitudinal portion being pivotably connected with said supporting member, said machine shaft having a further longitudinal portion which is rotatable about said longitudinal axis of the machine and axially non-displaceable, said first-mentioned longitudinal portion of the machine shaft having a first end which coincides with said longitudinal axis of the machine and is pivotably connected with said further longitudinal portion of said machine shaft, said first-mentioned longitudinal portion of said machine shaft having a second end which is radially displaceable from said longitudinal axis of the machine and is located at an opposite side of said common transverse plane, relative to said first end; and a turning link transmission which is supported rotatably about said longitudinal axis of the machine and has turning axes extending normally to said longitudinal axis of the machine, said second end of said first mentioned longitudinal portion of said machine shaft, which is located at an opposite side of said common transverse plane, being connected with said turning link transmission so as to rotate together with the latter.

2. A radial piston machine as defined in claim 1, wherein said displacing member is formed as a single-acting hydraulic cylinder-piston unit having a longitudinal axis which coincides with said longitudinal axis of the machine, said hydraulic cylinder-piston unit having an axially movable part; and further comprising a spring and a sliding piece displaceable against an elastic return force of said spring and being pivotably connected with said turning lever transmission, said axially movable part of said hydraulic cylinder-piston unit being supported on said sliding piece.

3. A radial piston machine as defined in claim 1, wherein said displacing member is formed as a double-acting hydraulic cylinder-piston unit having a longitudinal axis which coincides with said longitudinal axis of the machine, said hydraulic cylinder-piston unit having a piston rod; and further comprising a compensating link via which said piston rod is connected with said turning link transmission.

4. A radial piston machine as defined in claim 1, wherein said first mentioned turnable longitudinal portion of said machine shaft is formed rigid over its entire length, said supporting member which is connected with said first-mentioned turnable longitudinal portion of said machine shaft being displaceable parallel to said longitudinal axis of the machine.

5. A radial piston machine as defined in claim 1, wherein said first-mentioned turnable longitudinal portion of said machine shaft is formed as a hydraulically actuatable telescoping cylinder-piston unit having a housing which supports said supporting member, said working pistons being spatially pivotably supported on said supporting member.

6. A radial piston machine as defined in claim 1, wherein said turning link transmission has an axially non-displaceable support which is rotatable parallel to said transverse plane about said longitudinal axis of the machine, said first-mentioned turnable longitudinal portion of said machine shaft extending through said transmission support so as to be taken along with the latter in rotation and to be radially displaceable relative to the same, said turning link transmission having a first turning link which is pivotably connected with said transmission support at a radial distance from said longitudinal axis of the machine, a sliding piece member, a compensating link member, and a second turning link pivotably connected with said second end of said first-mentioned longitudinal portion of said machine shaft so that said first-turning link is pivotably connected with said second turning link and with one of said members.

7. A radial piston machine as defined in claim 1, wherein said turning link transmission has a transmission support rotatable parallel to said transverse plane about said longitudinal axis of said machine shaft, said first-mentioned turnable longitudinal portion of said machine shaft extending through said transmission support so as to be taken along in rotation and to be radially displaceable relative to the same, said turning link transmission having a turning link extending at a radial distance from said longitudinal axis of the machine and pivotably connected with another end of at least said first-mentioned turnable longitudinal portion of said machine shaft.

8. A radial piston machine as defined in claim 7, wherein said displacing member is formed as a hydraulic cylinder-piston unit having a piston rod, said turning link transmission having a compensating link member which is articulately connected with a central longitudinal region of said turning link and is pivotably connected with said piston rod of said hydraulic cylinder-piston unit.

9. A radial piston machine as defined in claim 7, wherein said rotatable transmission support is supported in an axially non-displaceable manner.

10. A radial piston machine as defined in claim 7, wherein said rotatable transmission member is supported in an axially displaceable manner; and further comprising adjusting means arranged to act on said rotatable transmission support.

* * * * *